US010806280B2

(12) United States Patent
Li

(10) Patent No.: US 10,806,280 B2
(45) Date of Patent: Oct. 20, 2020

(54) REMOVABLE NECK SUPPORT PILLOW FOR GARMENT

(71) Applicant: Bruce Li, Rowland Heights, CA (US)

(72) Inventor: Bruce Li, Rowland Heights, CA (US)

( * ) Notice: Subject to any disclaimer, the term of this patent is extended or adjusted under 35 U.S.C. 154(b) by 0 days.

(21) Appl. No.: 15/705,654

(22) Filed: Sep. 15, 2017

(65) Prior Publication Data

US 2019/0099021 A1 Apr. 4, 2019

(51) Int. Cl.

| | |
|---|---|
| ***A47G 9/10*** | (2006.01) |
| ***A41D 15/04*** | (2006.01) |
| ***A47C 7/38*** | (2006.01) |
| ***A41D 13/05*** | (2006.01) |
| ***A41D 3/00*** | (2006.01) |
| ***A41D 13/015*** | (2006.01) |

(52) U.S. Cl.

CPC ..... *A47G 9/1045* (2013.01); *A41D 15/04* (2013.01); *A47G 9/1027* (2013.01); *A47G 9/1081* (2013.01); *A41D 3/00* (2013.01); *A41D 13/0155* (2013.01); *A41D 13/0512* (2013.01); *A41D 2200/20* (2013.01); *A47C 7/38* (2013.01); *A47C 7/383* (2013.01)

(58) Field of Classification Search

CPC ..... A47C 7/383; A47C 7/38; A47G 9/1045; A47G 9/1027; A47G 9/1081; A41D 15/04; A41D 13/0155; A41D 13/0512; A41D 3/00; A41D 2200/20

See application file for complete search history.

(56) References Cited

U.S. PATENT DOCUMENTS

| | | | | | |
|---|---|---|---|---|---|
| 2,682,918 | A * | 7/1954 | Porter | A47C 7/021 | 267/117 |
| 3,017,221 | A * | 1/1962 | Emery | A47C 7/383 | 297/397 |
| 3,676,879 | A * | 7/1972 | Irie | A42B 1/045 | 2/202 |
| 3,765,412 | A * | 10/1973 | Ommaya | A61F 5/055 | 128/846 |
| 5,303,425 | A * | 4/1994 | Mele | A41D 13/0053 | 2/102 |
| D348,174 | S * | 6/1994 | Genis | D24/191 | |
| 5,402,535 | A * | 4/1995 | Green | A41D 13/018 | 128/DIG. 23 |
| 5,781,936 | A * | 7/1998 | Alaloof | A41D 13/018 | 2/456 |
| D399,675 | S * | 10/1998 | Ferris | D6/601 | |
| D410,810 | S * | 6/1999 | Lozier | 5/636 | |
| 5,937,443 | A * | 8/1999 | Kageyama | A41D 13/018 | 2/455 |
| 6,032,299 | A * | 3/2000 | Welsh | A41D 13/018 | 2/456 |

(Continued)

*Primary Examiner* — Nicholas F Polito
*Assistant Examiner* — Morgan J McClure

(57) ABSTRACT

An inflatable neck pillow is disclosed comprising a generally C-shaped inflatable pillow that approximates the shape of a human neck, wherein the pillow includes an air valve for inflating and deflating the same and means for securing the pillow within the compartment of a garment with a stowable hood. The pillow preferably has an upper portion and a lower portion, wherein the upper portion is longer than the lower portion, with an indentation or narrower portion between such that the pillow remains securely in place when inserted into the storage compartment of a garment collar.

5 Claims, 2 Drawing Sheets

(56) References Cited

U.S. PATENT DOCUMENTS 6,298,487 B1 * 10/2001 Mayhew ..... A41D 13/018 2/108
6,301,714 B1 * 10/2001 Son ..... A41D 13/0512 2/129
6,779,211 B1 * 8/2004 Williams ..... A47D 13/08 5/640
7,165,279 B1 * 1/2007 Georgescu ..... A47G 9/10 5/490
7,657,954 B1 * 2/2010 Bunkers ..... A42B 1/048 2/202
7,797,773 B1 * 9/2010 Wilk ..... A47C 7/383 5/640
7,841,344 B2 * 11/2010 Schlosser ..... A41D 13/018 128/205.22
7,845,019 B2 * 12/2010 Bowen ..... A41D 15/04 2/144
7,921,471 B2 * 4/2011 Mordecai ..... A62B 17/006 2/98
D704,963 S * 5/2014 McNeil ..... D6/601
8,726,421 B2 * 5/2014 Alvarez ..... A41D 13/0512 2/207
8,961,443 B2 * 2/2015 Bard ..... A61F 5/05816 602/36
9,009,867 B2 * 4/2015 Bowen ..... A41D 1/00 2/144
9,027,170 B2 * 5/2015 Dainese ..... A41D 13/018 2/455
9,332,796 B2 * 5/2016 Edwards ..... A41D 1/002
10,001,346 B2 * 6/2018 Augustine ..... F41H 1/00
10,173,629 B2 * 1/2019 Barbat ..... B60R 21/235
10,390,580 B2 * 8/2019 Olsson ..... A41D 13/0512
2005/0097673 A1 * 5/2005 Matthews Brown .. A47D 13/08 5/636
2007/0004298 A1 * 1/2007 Ganley ..... B63C 9/1255 441/88
2007/0033737 A1 * 2/2007 Melton ..... A47C 7/383 5/640
2007/0174970 A1 * 8/2007 Best ..... A47G 9/1027 5/644
2008/0229498 A1 * 9/2008 Grosso ..... A47C 7/383 5/244
2009/0019641 A1 * 1/2009 Ali ..... B60N 2/882 5/636
2009/0210993 A1 * 8/2009 Pendleton ..... A41D 23/00 2/207
2009/0211032 A1 * 8/2009 Lange ..... A47C 7/383 5/652
2012/0011655 A1 * 1/2012 Rojas ..... A47C 7/383 5/636
2013/0055504 A1 * 3/2013 Peash ..... A61G 5/14 5/654
2013/0145549 A1 * 6/2013 Piegdon ..... A61G 7/00 5/600
2013/0276236 A1 * 10/2013 Rasmussen ..... A47G 9/1027 5/640
2016/0345760 A1 * 12/2016 Pesale ..... A47G 9/109
2017/0042352 A1 * 2/2017 Atkinson ..... A47G 9/1081
2017/0086606 A1 * 3/2017 Kassab Arabo ..... A47G 9/066
2017/0188710 A1 * 7/2017 Sternlight ..... A47G 9/10
2018/0049568 A1 * 2/2018 Cruz ..... A47G 9/1027
2018/0084919 A1 * 3/2018 Rayburn ..... A47C 16/00
2018/0125271 A1 * 5/2018 Blanc ..... A47G 9/0253

* cited by examiner

REMOVABLE NECK SUPPORT PILLOW FOR GARMENT

FIELD OF THE INVENTION

The present invention relates generally to a removable neck pillow for use in a garment. In particular, the invention relates to a neck pillow that may be inserted into the collar of a garment that already has a stowable hood.

BACKGROUND OF THE INVENTION

During air, train, boat, bus, or even extended length automobile travels, passengers often use a neck pillow to support their heads and necks. However, travelers who desire to travel with a dedicated neck pillow must remember to pack the pillow, which can take up space in a bag. Additionally, they may accidentally leave the pillow on a plane or in another vehicle. Carrying the pillow does not solve the issue because it may be bulky. Inflatable neck pillows may solve some of these concerns, but their use still causes other problems. For example, a separate inflatable neck pillow may still be misplaced, or may still fall off or move out of position while the user is sleeping. This can cause the user to sleep for extended periods of time with poor neck posture, which may result in pain or even injury over time.

SUMMARY OF THE INVENTION

The present invention solves the general problems present in the prior art by providing a neck pillow that may be stowed inside a compartment of a jacket with a stowable hood. It is shaped in such a way that, when deflated, the pillow can be stowed inside the zipper pouch of a jacket with a stowable hood. When inflated, the inner half of the neck pillow is inflated to a point where the ends of the pillow anchor inside the collar of the garment, using the cavity inside the garment to hold the pillow securely from movement. The outside half of the pillow is then used to support the neck and head of the user and can be shaped in many ways. A particular advantage of the present invention is that it is compatible with a number of different jackets and may be easier and cost less to manufacture than a full jacket with a built-in inflatable neck support.

It is one object of the present invention to provide an inflatable neck support for travelers.

It is a further object of the present invention to provide a neck support that may be inflated or deflated easily via an air valve.

It is a further object of the present invention to provide a neck support that may be stowed within a compartment of a jacket with a stowable hood.

It is a further object of the present invention to provide a neck support that is compatible with any jacket with a stowable hood.

It is a further object of the present invention to provide a product that may be made in different sizes to accommodate users with necks of different thickness or length.

These objectives are illustrative in nature. Additional advantages and applications for the present invention will be readily apparent to persons skilled in the art upon a review of the invention and the disclosures contained herein.

BRIEF DESCRIPTION OF THE DRAWINGS

The drawings referenced below are included so that the features and advantages of the presently disclosed invention may be better understood. It should be noted, however, that the attached drawings are meant only to be illustrative of particular embodiments of the invention and should not be considered limiting of its scope. The invention itself, as well as a preferred mode of use, further objectives and advantages thereof, will best be understood by reference to the following detailed description of the preferred embodiment when read in conjunction with the attached drawings, which are summarized below.

DETAILED DESCRIPTION OF THE INVENTION

Figure 1:
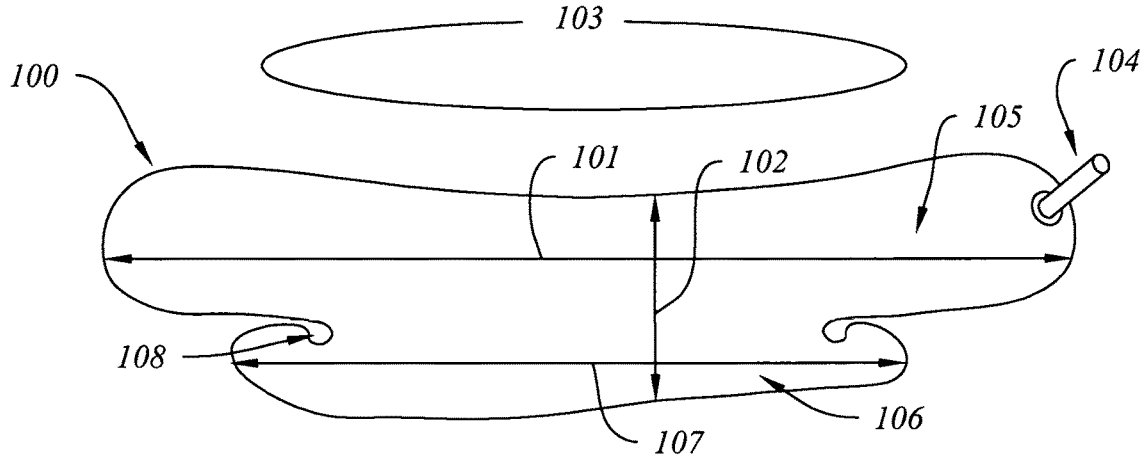
FIG. 1 depicts an inflatable neck support in accordance with a preferred embodiment of the present invention.

Presently preferred embodiments of the invention are shown in the above-identified figures and described in detail below. In describing the preferred embodiments, like or identical reference numerals are used to identify common or similar elements. The figures are not necessarily to scale, and certain features and certain views of the figures may be shown exaggerated in scale or in schematic in the interest of clarity and conciseness.

The preferred embodiment of the present invention comprises a neck pillow that may be stowed inside a compartment of a jacket with a stowable hood. It is shaped in such a way that, when deflated, the pillow can be stowed inside the zipper pouch of a jacket with a stowable hood. When inflated, the inner half of the neck pillow is inflated to a point where the ends of the pillow anchor inside the collar of the garment, using the cavity inside the garment to hold the pillow securely from movement. The outside half of the pillow is then used to support the neck and head of the user and can be shaped in many ways. For example and without limitation, the pillow may be manufactured in such a way that it can provide minimal support for minimal bulk inside the collar. It could be manufactured in such a way that it provides extended side support so the head can rest when the user is in an upright position. Ideally, the pillow approximates a C shape to accommodate the contour of the user's neck. With this in mind, the pillow may preferably be made in varying sizes to accommodate wearers with different size or length necks. For example, a smaller neck pillow may be needed for a child user (e.g., with a 12" neck), while a larger size may be needed for a larger adult user (e.g., with a 19" neck). Additionally, the pillow may be constructed of any safe inflatable material, such as rubber, plastic polymer, or fabric with an air-tight coating or sealant. Additionally, the material may be elastic or non-elastic.

FIG. 1 depicts an inflatable neck support 100 in accordance with a preferred embodiment of the present invention. The neck support 100 has a length 101 and a thickness 102, each predetermined during manufacturing based on the desired user of the device. The length 101 has a curvature 103, corresponding to the approximate shape of the desired user. The neck support 100 preferably has an air valve 104 that may be used to inflate or deflate the neck pillow as desired. Although the preferred embodiment has an air valve 104 as shown, other means for inflating or deflating the neck pillow 100 are also contemplated and within the scope of the present invention, such as battery-powered inflation packs or tire-type inflation systems (e.g., Presta valves, Schrader valves, or Wood's valves). Additionally, the inflatable neck support 100 features an upper portion 105 and a lower portion 106, wherein the lower portion 106 is wider than the opening of a zipper (or other sealable) opening on the neck of a jacket (not shown). Ideally, the length 101 of the upper portion of the neck pillow is greater than the length 107 of the lower portion, such that there is an indentation or narrower portion 108 that is appropriately sized to fit through an opening of the garment (e.g., a zipper or button opening). With this configuration, the inflatable neck pillow 100 stays securely placed within the collar of the jacket when in use.

Figure 2:
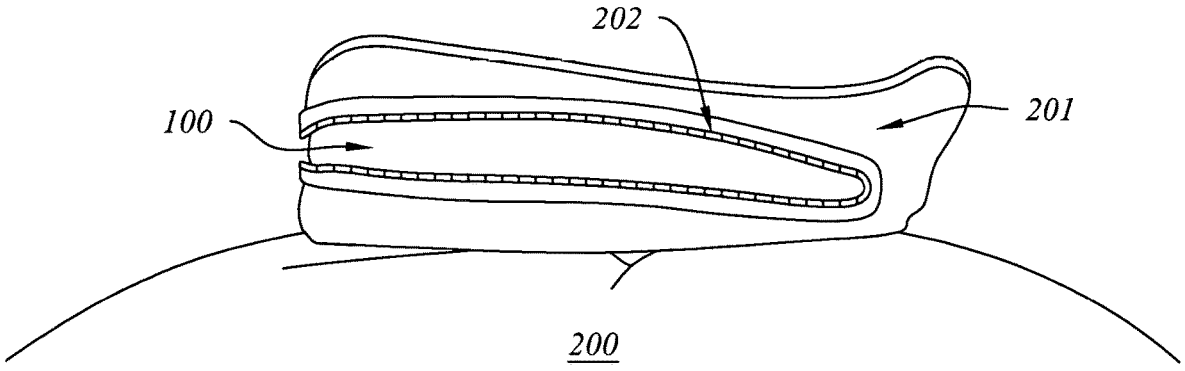
FIG. 2 depicts the inflatable neck support of FIG. 1 as seen inside an unzipped collar of a jacket.

FIG. 2 depicts the inflatable neck support 100 of FIG. 1 as seen inside an unzipped collar of a jacket 200. Jacket 200 is a typical jacket with a stowable hood (not shown), that may be stowed within a collar 201 and secured with a zipper 202.

Figure 3:
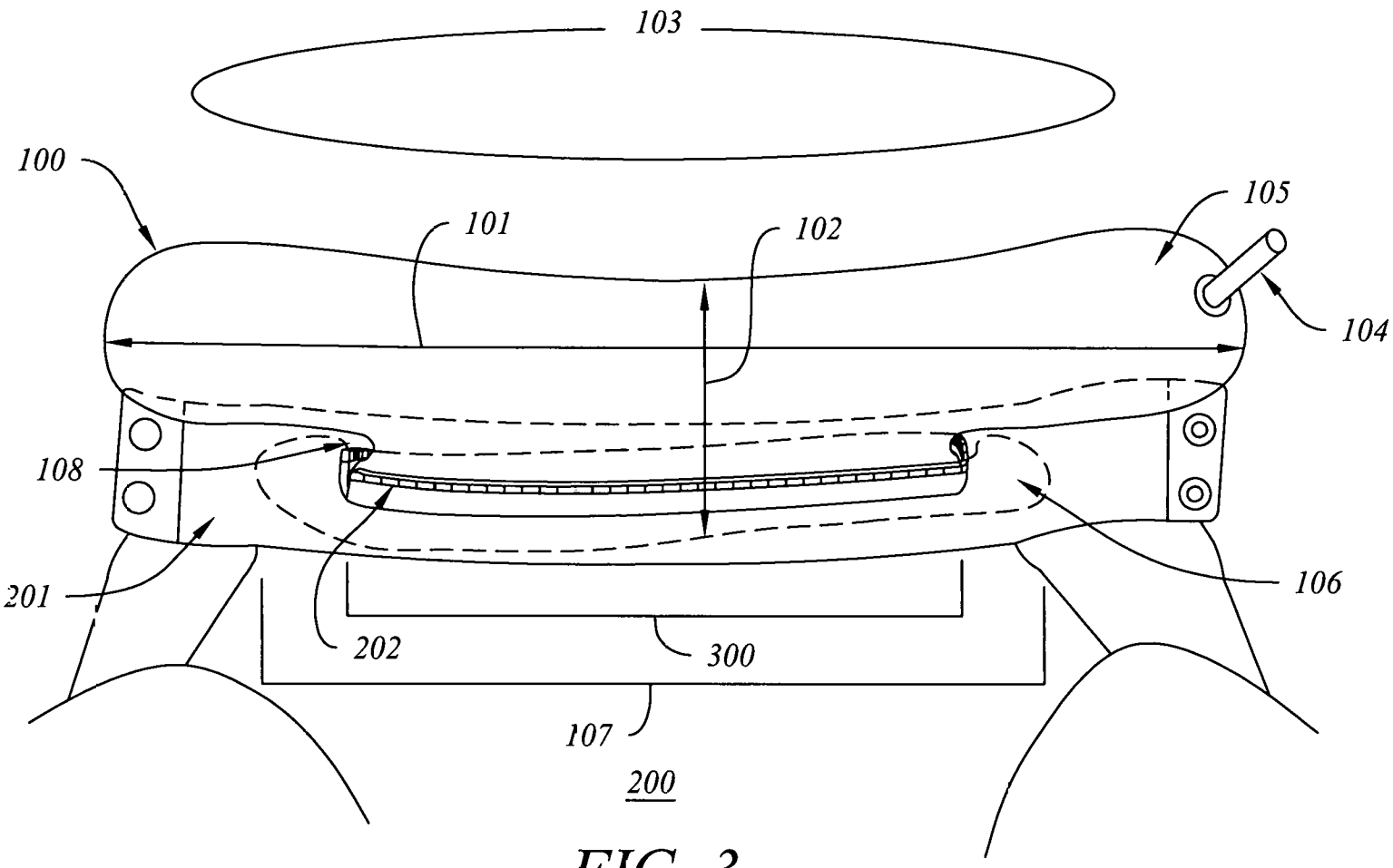
FIG. 3 depicts the inflatable neck support of FIG. 1 as seen from behind a jacket when the neck support is inflated.

FIG. 3 depicts the inflatable neck support 100 of FIG. 1 as seen from behind a jacket 200 when the neck support is inflated. The neck support 100 has a length 101 and a thickness 102, each predetermined during manufacturing based on the desired user of the device. The length 101 has a curvature 103, corresponding to the approximate shape of the desired user. The neck support 100 preferably has an air valve 104 that may be used to inflate or deflate the neck pillow as desired. Although the preferred embodiment has an air valve 104 as shown, other means for inflating or deflating the neck pillow 100 are also contemplated and within the scope of the present invention, such as battery-powered inflation packs or tire-type inflation systems (e.g., Presta valves, Schrader valves, or Wood's valves). Additionally, the inflatable neck support 100 features an upper portion 105 and a lower portion 106 (the outline of which is indicated with the dotted lines in the figure), wherein the lower portion 106 is wider than the opening 300 of the collar 201. The opening is ideally sealable, such as with a zipper, buttons, snaps, magnets, or other means. Ideally, the length 101 of the upper portion is greater than the length 107 of the lower portion, such that there is an indentation or narrower portion 108 that is appropriately sized to fit through an opening of the garment. With this configuration, the inflatable neck pillow 100 stays securely placed within the collar 201 of the jacket 200 when in use. Alternative means for securing the inflatable neck pillow 100 within the collar 200 are also contemplated as being within the scope of the present invention, including flexible rods in place of the lower portion 106.

Although the invention has been described with reference to one or more particular embodiments, this description is not meant to be construed in a limiting sense. Various modifications of the disclosed embodiments as well as alternative embodiments of the invention will become apparent to persons skilled in the art upon reference to the description of the invention. It is therefore contemplated that the appended claims will cover any such modifications or embodiments that fall within the scope of the invention.

The invention claimed is:

1. An inflatable neck pillow configured to be inserted into a collar of a garment having a storage compartment for a stowable hood, comprising:

body comprising an elongated, curved length with an upper portion and a lower portion, each of said upper portion and lower portion having a length and a girth;

an air valve integrated into said upper portion and configured to inflate both the upper portion and the lower portion of said body;

wherein the length of said upper portion is greater than the length of said lower portion;

wherein the girth of said upper portion is greater than the girth of said lower portion;

wherein said upper portion is configured to extend outside the collar of said garment when inflated;

wherein said lower portion is configured to remain inside the collar of said garment, thus preventing said inflatable neck pillow from falling out of said garment when in use; and wherein said inflatable neck pillow is configured to be deflated and stowed in said collar after use.

2. The inflatable neck pillow of claim 1, further comprising:

an indented portion between said upper portion and said lower portion, wherein said indented portion has a length smaller than said upper portion and said lower portion.

3. The inflatable neck pillow of claim 1, wherein said body is made of an elastic material.

4. The inflatable neck pillow of claim 1, wherein said body is made of a non-elastic material.

5. The inflatable neck pillow of claim 1, wherein said lower portion comprises at least one flexible rod.

* * * * *